US012410557B2

(12) United States Patent
Thaller

(10) Patent No.: US 12,410,557 B2
(45) Date of Patent: Sep. 9, 2025

(54) PROCESS AND APPARATUS FOR WHITE LIQUOR OXIDATION

(71) Applicant: Messer Austria GmbH, Gumpoldskirchen (AT)

(72) Inventor: Bernhard Thaller, Ulmerfeld-Hausmening (AT)

(73) Assignee: Messer Austria GmbH, Gumpoldskirchen (AT)

( * ) Notice: Subject to any disclaimer, the term of this patent is extended or adjusted under 35 U.S.C. 154(b) by 51 days.

(21) Appl. No.: 17/996,527

(22) PCT Filed: Mar. 17, 2021

(86) PCT No.: PCT/EP2021/056881
§ 371 (c)(1),
(2) Date: Oct. 19, 2022

(87) PCT Pub. No.: WO2021/213741
PCT Pub. Date: Oct. 28, 2021

(65) Prior Publication Data

US 2023/0313456 A1 Oct. 5, 2023

(30) Foreign Application Priority Data

Apr. 23, 2020 (DE) ..... 10 2020 002 446.7

(51) Int. Cl.
*D21C 11/00* (2006.01)
*D21C 3/02* (2006.01)
(Continued)

(52) U.S. Cl.
CPC ..... *D21C 11/0057* (2013.01); *D21C 3/026* (2013.01); *D21C 3/222* (2013.01); *D21C 9/147* (2013.01)

(58) Field of Classification Search
CPC ..... D21C 11/0057; D21C 9/147
See application file for complete search history.

(56) References Cited

U.S. PATENT DOCUMENTS 4,053,352 A 10/1977 Hultman et al.
4,886,577 A 12/1989 Wiley
(Continued)

FOREIGN PATENT DOCUMENTS

CA 2111519 A1 7/1994
EP 588704 A2 3/1994
(Continued)

OTHER PUBLICATIONS

Yasui et al., Mysteries of bulk nanobubbles (ultrafine bubbles); stability and radical formation, May 2018, Ultrasonics—Sonochemistry, p. 259-266 (Year: 2018).*
(Continued)

*Primary Examiner* — Anthony Calandra
(74) *Attorney, Agent, or Firm* — Andrus Intellectual Property Law, LLP

(57) ABSTRACT

In a process for oxidation of white liquor, in particular of white liquor used in a process of production of paper or cellulose, the oxygen required for the oxidation is supplied to the reactor or the reactors in which the oxidation is carried out at least partially in the form of oxygen-containing nanobubbles. Due to the relatively long lifetime of the nanobubbles this very efficiently provides oxygen also for oxidation reactions in the white liquor proceeding at different rates.

14 Claims, 1 Drawing Sheet

(51) Int. Cl.
*D21C 3/22* (2006.01)
*D21C 9/147* (2006.01)

(56) References Cited

U.S. PATENT DOCUMENTS

| | | | | |
|---|---|---|---|---|
| 5,382,322 | A * | 1/1995 | Magnotta | D21C 11/0071 162/239 |
| 5,500,085 | A | 3/1996 | Magnotta et al. | |
| 6,382,601 | B1 | 5/2002 | Ohnari | |
| 8,465,642 | B2 * | 6/2013 | Kazem | C02F 1/24 261/92 |
| 10,293,312 | B2 | 5/2019 | Goi | |
| 2002/0077373 | A1 * | 6/2002 | Hudson | C02F 1/34 516/98 |
| 2008/0142175 | A1 | 6/2008 | Yin | |
| 2009/0000751 | A1 | 1/2009 | Yin | |
| 2009/0107642 | A1 | 4/2009 | Snekkenes et al. | |
| 2012/0175791 | A1 * | 7/2012 | Anzai | B01F 23/23123 261/122.1 |
| 2014/0102648 | A1 | 4/2014 | Vehmaa | |
| 2018/0370867 | A1 | 12/2018 | Lu | |
| 2019/0083945 | A1 | 3/2019 | Zhang et al. | |
| 2021/0189648 | A1 * | 6/2021 | Lampinen | D21C 11/04 |
| 2023/0203751 | A1 | 6/2023 | Thaller | |

FOREIGN PATENT DOCUMENTS

| | | | | |
|---|---|---|---|---|
| EP | 573892 | B1 | 9/1996 | |
| EP | 1161592 | A1 | 12/2001 | |
| EP | 1528149 | A1 | 5/2005 | |
| JP | H07258987 | A | 10/1995 | |
| JP | 2006342434 | A * | 12/2006 | |
| OA | 17752 | A * | 10/2014 | C22B 3/02 |
| WO | WO-9401616 | A1 * | 1/1994 | D21C 11/0071 |
| WO | 2000044978 | A1 | 8/2000 | |
| WO | 2001020075 | A1 | 3/2001 | |
| WO | 2006071165 | A1 | 7/2006 | |
| WO | 2013178885 | A1 | 12/2013 | |
| WO | 2015067446 | A1 | 5/2015 | |
| WO | 2017091129 | A1 | 6/2017 | |
| WO | 2019003655 | A1 | 1/2019 | |
| WO | WO-2019077202 | A1 * | 4/2019 | D21C 11/0057 |
| WO | 2017217402 | A1 | 1/2021 | |

OTHER PUBLICATIONS

Holland, Rockwell, Controlled Cavitation Can Increase Recvoery Efficiency, Mar. 2005, TAPPI Solutions!, p. 21-22 (Year: 2005).*
English summary of JP2006342434A, 2006 (Year: 2006).*
International Search Report and Written Opinion in PCT/EP2021/056881, dated Jun. 11, 2021, 6 pages.

* cited by examiner

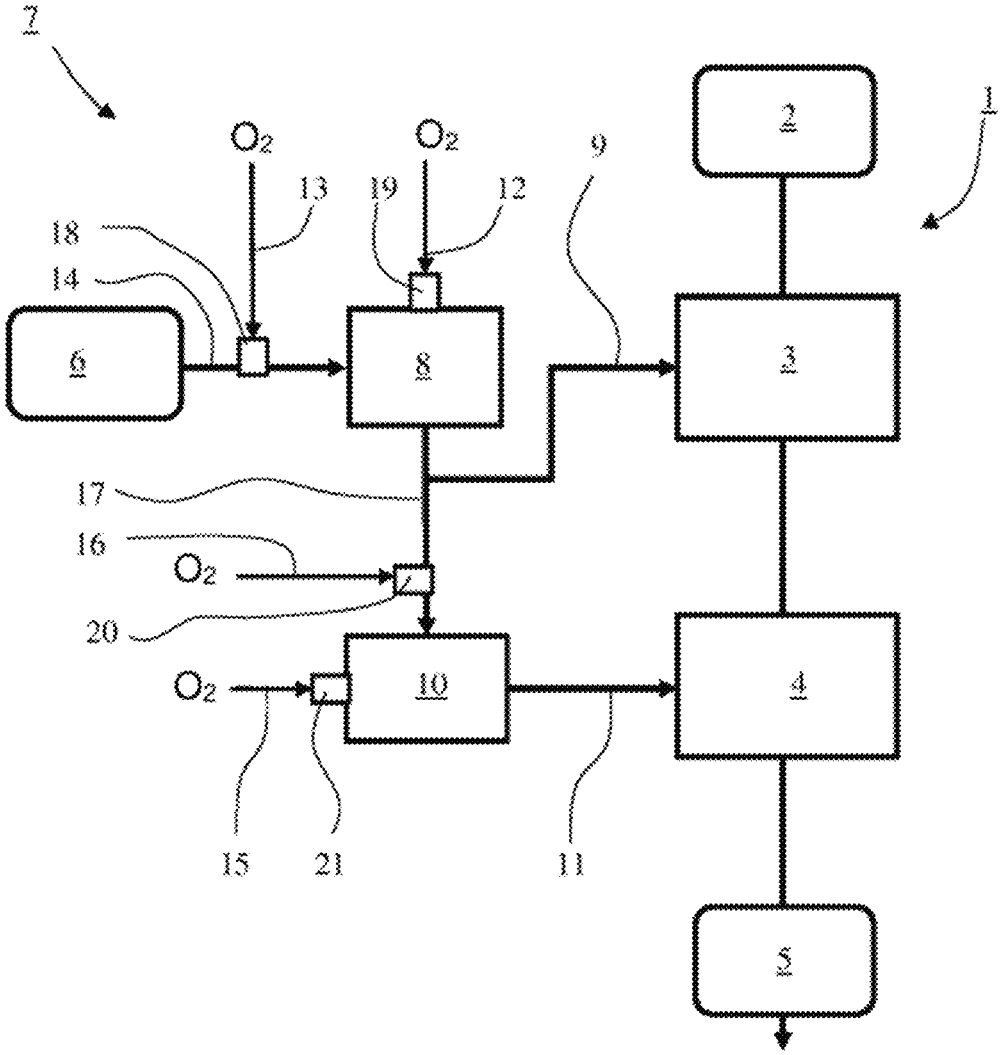
7
1
2
3
4
5
6
8
10
9
11
12
13
14
15
16
17
18
19
20
21
O2
O2
O2
O2

PROCESS AND APPARATUS FOR WHITE LIQUOR OXIDATION

CROSS-REFERENCE TO RELATED APPLICATIONS

The present application is the U.S. national stage application of international application PCT/EP2021/056881 filed Mar. 17, 2021, which international application was published on Oct. 28, 2021, as International Publication WO 2021/213741 A1. The international application claims priority to German Patent Application No. 10 2020 002 446.7 filed Apr. 23, 2020.

FIELD

The invention relates to a process for oxidizing white liquor, in which white liquor is contacted with oxygen in a reactor and hence sulfur compounds in the white liquor are oxidized. The invention further relates to a corresponding apparatus.

BACKGROUND

White liquor is the digestion medium in sulfate pulp cooking. It essentially comprises an aqueous solution of NaOH and $Na_2S$. It is used in the kraft pulp process as cooking liquor for the digestion of wood. The cooking liquor consumed in the digestion, which is referred to as black liquor, is subsequently concentrated and incinerated. The melt of inorganic chemicals obtained as a residue in the incineration is dissolved to form what is called green liquor, consisting essentially of sodium carbonate and sodium sulfide. The sodium carbonate is then converted to sodium hydroxide by causticization, and in this way white liquor is produced again.

A portion of the white liquor is often also used in further processes for chemical pulp production. In particular, white liquor may be used for pH adjustments of alkaline processes, for instance alkaline oxygen delignification, alkaline extraction or peroxide bleaching. This is especially advantageous in that these bleaching stages are often incorporated into the liquor recovery process. If pure sodium hydroxide were used rather than the white liquor, the constant addition of Na to the circulation would change the Na/S ratio in the white liquor.

However, the sulfide in the white liquor causes unwanted side reactions in alkaline delignification and bleaching stages. It disrupts the process regime of oxygen delignification, reduces the efficacy of the breaches and increases the degradation of the cellulose in the bleaching operation. Therefore, if the intention is to use white liquor in these process steps, this sulfide has to be oxidized:

(a) For oxygen delignification at least to thiosulfate ("partially oxidized white liquor")

(b) For peroxide bleaching to sulfate ("totally oxidized white liquor").

The first reaction step (a) to give thiosulfate proceeds very quickly, while the second reaction step (b) to give sulfate takes much more time. It is very frequently also the case that these process steps are conducted in two separate reactors.

Oxidizing agents used for white liquor oxidation may be air, oxygen-enriched air, or pure oxygen. Introduction of gas as uniformly as possible and rapid dissolution of the gas is of major importance for this process.

WO 00/44978 A1 describes a process in which white liquor containing mainly sodium sulfide, sodium hydroxide and water is first contacted with an oxygenous gas for oxidation of sodium sulfide to sodium thiosulfate. Subsequently, the white liquor is contacted with hydrogen peroxide for oxidation of sodium thiosulfate to sodium sulfate.

U.S. Pat. No. 5,500,085 B1 A describes a two-stage process for white liquor oxidation in a kraft process. This involves removing sulfide from the white liquor by means of oxygen in a first step, and converting a significant portion of the sulfur compounds still present in the white liquor to sulfates in a second step. The resulting white liquor is used as alkali source for various processes in further chemical pulp production processes.

Various processes and apparatuses for white liquor oxidation from the prior art are also described in WO 2013/178885 A1. WO 2013/178885 A1 itself proposes a process for white liquor oxidation in which a substream of white liquor is taken from a stream conducted through a conduit, mixed vigorously with oxygen in a mixer, and then fed back into the main stream of the white liquor. This is intended to achieve vigorous mixing of white liquor and oxygen and to bring about rapid oxidation of the sulfides. The effect of the vigorous mixing is that the oxygen takes the form of small bubbles and, in this respect, there is a high surface-to-volume ratio that promotes the reaction of the sulfur compounds in the white liquor. However, the oxygen bubbles have a tendency to coagulate and, on account of their buoyancy, make rapidly for the surface, which distinctly reduces the efficiency of the process. This is especially true of the sulfate-forming reactions, which proceed comparatively slowly.

SUMMARY

It is therefore an object of the invention to specify a process and an apparatus for white liquor oxidation, in which the efficiency of the reaction between the oxygen supplied and the sulfur compounds present in the white liquor is improved compared to prior art processes, and which assures efficient oxygen supply especially also for the comparatively slow formation of sulfates.

This object is achieved by a process having the features of claim 1. Advantageous configurations of the invention are specified in the dependent claims.

According to the invention, the oxygen required for the oxidation of the white liquor is thus introduced at least partly in the form of nanobubbles. The nanobubbles are produced either directly in a reactor in which oxidation of the white liquor takes place or indirectly by introducing oxygen into a conduit that conveys water or an aqueous fluid directly or indirectly into such a reactor. At least within the reactor, the oxygen is thus at least partly in the form of nanobubbles in the white liquor.

Nanobubbles here shall be understood to mean gas bubbles having a diameter between 20 nm and 1 μm. The term "nanobubble" is especially meant by way of distinction from larger bubbles having a diameter between 1 μm and 100 μm, which in the context of the present invention are referred to as "microbubbles". It has been found in various studies that nanobubbles having a diameter of more than 20 nm can remain stable in water over a long period of several weeks or even longer. By contrast with microbubbles, they do not rise to the surface of water, since the rising motion caused by the comparatively small buoyancy force is disrupted by Brownian molecular motion and almost completely eliminated. At the same time, the zeta potential at the surface of the nanobubbles is large enough to compensate for the surface tension and thus to prevent dissolution of the nanobubble. Only at a diameter of well below 20 nm does surface tension become dominant, collapsing the nanobubbles and causing them to disappear within fractions of a second. Moreover, nanobubbles, on account of repulsive interactions of their surfaces, do not tend to coagulate. A size of the nanobubbles that is preferred in the context of the invention is an average diameter between 20 nm and below 1 μm, preferably an average diameter between 20 nm and 500 nm, more preferably between 20 nm and 200 nm.

Processes and apparatuses for generation of nanobubbles in aqueous systems are described, for example, in US 2012/0175791 A1, US 2019/0083945 A1, U.S. Pat. No. 6,382,601 B1, U.S. Pat. No. 10,293,312 B2 or WO 2017/217402 A1, to which reference is made here, but without any intention that the manner of introduction of the nanobubbles according to the present invention be restricted to these known systems. What is essential to the present invention is that the apparatus is designed such that a significant portion of the oxygen supplied to an aqueous fluid is produced in the fluid in the form of nanobubbles. This is accomplished, for example, by introducing the oxygen through a nozzle or a bubbling apparatus manufactured at least partly from a porous material, for instance sintered ceramic, the pore diameter of which is sufficiently large as to form nanobubbles of the desired order of size that are stable in the fluid. For example, the diameters of the pores in the porous material are likewise in the nanoscale range, i.e. below 1 μm.

Nanobubbles are capable of exchanging matter with their environment. A nanobubble laden with a particular gas, depending on the saturation of this gas in a surrounding solution, can release gas molecules into or absorb them from the solution. In the context of white liquor oxidation, the nanobubbles are filled with oxygen or an oxygenous gas, such as air or air enriched with oxygen and thus constitute a stable reservoir of oxygen. The oxygen introduced in the form of nanobubbles has only a very low tendency to coagulate to larger gas bubbles and/or to rise to the surface.

Parameters such as pH and salinity have an influence especially on the minimum size of the nanobubbles from which the nanobubbles can be present stably in the white liquor. In order to ensure that a maximum proportion of the oxygen may be present in the white liquor in the form of stable nanobubbles, it is therefore appropriate to choose the size of the introduction system so as to take account of the average size of the bubbles produced on introduction and the stability thereof under the conditions that prevail in the white liquor. This can be effected empirically, for example, by testing various introduction systems prior to sustained implementation and determining the suitability thereof for the respective chemical system.

The dosage of the oxygen in the form of nanobubbles may thus be implemented in the process of oxidation of the white liquor either in the partial oxidation, in which the sulfide present in the white liquor is oxidized to thiosulfate, or in the full oxidation, in which the sulfur compounds present in the white liquor are reacted with oxygen to give sulfate. It is sufficient in principle to supply the amount of oxygen envisaged for full oxidation in the form of nanobubbles at the start of the process. i.e., for instance, before feeding it to a first reactor used for white liquor oxidation. If a two-stage oxidation is being effected in two separate reactors connected in series and a substream of the white liquor only partly oxidized in the first reactor is being drawn off, for example as alkali source for the oxygen delignification, however, it is advantageous to introduce oxygen in the form of nanobubbles in both reactors. It is of course possible to use the inventive feeding of the oxygen in the form of oxygen-containing nanobubbles even when only a single-stage process regime with just one reactor is being effected, in which a partial or complete oxidation of the white liquor is being conducted.

The arrangement and operation of mechanical devices, such as stirrers, rotors etc. in conjunction with the introduction of the oxygen, must be effected such that mechanical effects such as strong shear forces or cavitations do not impair the stability of the nanobubbles.

The white liquor treated with oxygen in accordance with the invention is particularly advantageously suitable as alkali source in bleaching stages of a chemical pulp bleaching operation, especially in alkaline oxygen delignification and/or in peroxide bleaching. On account of the high lifetime of the nanobubbles, it is even conceivable here that a portion of the oxygen supplied in the white liquor oxidation is still present in the form of nanobubbles in the bleaching stages, where it directly assists the respective bleaching reaction.

The object of the invention is also achieved by an apparatus for oxidation of white liquor having the features of claim 5. An apparatus of the invention is equipped with a reactor in which white liquor is contacted with oxygen and hence sulfur compounds in the white liquor are oxidized, wherein the reactor itself and/or a feed for the white liquor or for an aqueous fluid to be supplied to the reactor that has flow connection to the reactor has an assigned introduction device for introduction of oxygen in the form of nanobubbles.

The introduction device is arranged in the reactor and/or the feed so as to enable supply of oxygen in the form of oxygen-containing nanobubbles directly into the fluid present in the reactor or the feed. For example, the introduction device is equipped for this purpose with a nozzle or a bubbling system having a section made of a porous material, such as sintered metal or sintered ceramic, the pore diameter of which is sufficiently large as to form nanobubbles of the desired order of size that are stable in the fluid.

BRIEF DESCRIPTION OF THE DRAWING

The drawing is intended to elucidate a working example of the invention. The sole drawing shows a flow diagram for a white liquor oxidation in which the treated white liquor is subsequently sent to a bleaching process.

DETAILED DESCRIPTION

The sole drawing shows the feeding of treated white liquor into a process 1 for bleaching of chemical pulp, as used, for example, during the production of cellulose fibers. During the bleaching process 1, an aqueous chemical pulp suspension 2 containing not only chemical pulp but also fractions of lignin passes through multiple stages that proceed in succession, two of which are shown here, namely an alkaline oxygen delignification 3 and an oxygen-enhanced peroxide bleaching 4. Further bleaching stages, for instance an oxygen-enhanced extraction, may likewise be present, but are not shown here.

In the oxygen delignification 3, the chemical pulp suspension 2 is treated with oxygen in an alkaline environment in one or more reactors at high temperatures. This removes significant proportions of the lignin still present in the suspension by reaction with oxygen. For reasons of clarity, just one process step for oxygen delignification 3 is shown here in abstract form; the oxygen delignification 3 may, however, be effected either in a single reactor or—as is customary in modern bleaching processes—in multiple stages in multiple reactors connected in series.

The oxygen delignification 3 requires an alkaline medium having a pH of about pH=11 at a temperature between 80° C. and 105° C. The alkaline medium is achieved by the supply of an alkali to the reactor(s), as elucidated in detail below. The suspension here has an average consistency of, for example, 10% to 14%. Oxygen or an oxygenous gas is introduced into the reactor(s). In the comparatively unusual case nowadays of a one-stage oxygen delignification, the treatment is effected at a pressure of, for example, 7 to 8 bar in the feed and 4.5 to 5.5 bar in the output from the (single) reactor. The treatment time (retention time) here is, for example, 50 to 60 min. In the case of a two-stage oxygen delignification, there is generally a difference in pressure and reaction time in the two reactors. In the first stage, for example, a customary pressure is a pressure of 7 to 10 bar and a customary retention time is 10 to 15 minutes, and in the second stage a pressure of 3 to 5 bar with a retention time of about 1 h.

In the peroxide bleaching 4, the suspension is supplied, as a further bleaching agent, with a peroxide, especially hydrogen peroxide ($H_2O_2$), although the efficiency of this process step can also be significantly improved by addition of oxygen ("PO", oxygen-enhanced peroxide bleaching). The treatment is effected in a reactor, for example at atmospheric pressure and a temperature of, for example, between 85° C. and 90° C. or under an elevated pressure at temperatures of, for example, between 100° C. and 110° C. The peroxide bleaching 4 is also effected in alkaline medium which is produced by supply of an alkali, as likewise elucidated in detail below. The suspension 5 of bleached chemical pulp produced in the bleaching stages 3, 4 is subsequently sent to further process steps that are of no interest here.

The alkali used for production of the alkaline medium in the bleaching stages 3, 4 in the working example disclosed here is white liquor. The white liquor consisting predominantly of sodium sulfide and sodium hydroxide is used in the kraft process for digestion of cell walls and can subsequently be recovered. In the working example according to the sole drawing, for example, recovered white liquor 6 is fed to bleaching stages 3, 4, but it is also possible to branch off a substream of the white liquor intended for digestion and to use it in the manner described here.

In order to be usable in the bleaching stages 3, 4, the sodium sulfide present in the white liquor that would disrupt the bleaching operation must be removed. For this purpose, the white liquor 6 is sent to a process for white liquor oxidation 7. In the white liquor oxidation 7, the sulfide is converted by supply of oxygen in the form of air, an oxygen-rich gas or pure oxygen (having a purity of 95% by volume or more) to thiosulfate ("partly oxidized white liquor") and/or to sulfate ("fully oxidized white liquor"). Partly oxidized white liquor is suitable for the bleaching process in the oxygen delignification 3, while fully oxidized white liquor is also usable for peroxide bleaching 4.

In the working example shown here, the white liquor 6 is first fed to a first reactor 8 in which there is partial oxidation of the white liquor 6. A substream of the partly oxidized white liquor formed is fed via a feed 9 to the oxygen delignification 3. The remaining substream of the partly oxidized white liquor is fed to a second reactor 10 in which there is full oxidation of the white liquor. The fully oxidized white liquor is fed via a feed 11 to the peroxide bleaching 4.

The oxygen required for the oxidation of the white liquor can be fed directly or indirectly to the reactors 8, 10. According to the invention, at least a portion of the oxygen is introduced in the form of nanobubbles, i.e. bubbles having an average diameter between 20 nm and 1000 nm. In the working example shown here, by way of example, various options for sites where oxygen can be introduced in the form of nanobubbles are shown.

For example, for partial oxidation of the white liquor, oxygen can be introduced directly into the reactor 8 in the form of nanobubbles via an oxygen feed 12 or via the feeding of oxygen in the form of nanobubbles via an oxygen feed 13 that opens into a feed 14 for white liquor that leads to the reactor 8.

Owing to the comparatively long lifetime of the nanobubbles, introduction of oxygen via the oxygen feeds 12, 13 is also sufficient for the subsequent full oxidation of the white liquor in the reactor 10. Alternatively, for full oxidation, there is an additional introduction of oxygen in the form of nanobubbles, either directly into the reactor 10 via an oxygen feed 15 or via an oxygen feed 16 that opens into a feed 17 for partly oxidized white liquor that leads to the reactor 10. In addition, the oxygen in the form of nanobubbles may also be introduced into a feed for an aqueous medium, for example fresh water, that opens into the feed 14, 17, but this is not shown here.

The nanobubbles are produced in each case at the opening of the oxygen feeds 12, 13, 15, 16 into the respective fluid-conducting conduit 14, 17 or the respective reactor 8, 10 at suitable introduction devices 18, 19, 20, 21. All that is required here is that, in operation of the introduction devices 18, 19, 20, 21, this at least with one apparatus that produces the nanobubbles, for example a nozzle or a bubbling system or a section thereof, are surrounded by water or an aqueous fluid, such that the nanobubbles can form in the aqueous phase. The nanobubbles are then entrained by the flow of the respective fluid and hence arrive in the respective reactor 8, 10 for the reaction.

Incidentally, it is in no way a requirement in the context of the invention that oxygen be introduced exclusively in the form of nanobubbles. It is instead also possible that the introduction of oxygen in the form of nanobubbles is undertaken in addition to other modes of introduction for the oxygen, as known, for example, from the prior art.

The process of the invention and the apparatus of the invention make it possible to use the oxygen introduced into the white liquor over the course of the various oxidation reactions with significantly higher efficiency than is the case in prior art processes. The small size of the nanobubbles enables uniform distribution of the oxygen in the white liquor, and they constitute a sustainably available oxygen reservoir for the comparatively slow oxidation of the sulfur compounds in the white liquor to sulfate.

LIST OF REFERENCE NUMERALS

1. Process for bleaching
2. Chemical pulp suspension
3. Alkaline oxygen delignification
4. Peroxide bleaching
5. Suspension of bleached chemical pulp
6. White liquor
7. White liquor oxidation
8. Reactor
9. Feed (for partly oxidized white liquor)
10. Reactor
11. Feed (for partly oxidized white liquor)
12. Oxygen feed
13. Oxygen feed
14. Feed (for white liquor)

15. Oxygen feed
16. Oxygen feed
17. Feed (for partly oxidized white liquor)
18. Introduction device
19. Introduction device
20. Introduction device
21. Introduction device

The invention claimed is:

1. A process for oxidizing white liquor, the process comprising:

contacting unoxidized white liquor with oxygen in a first reactor to partially oxidize the white liquor, thereby partially oxidizing sulfur compounds in the white liquor;

feeding the partially oxidized white liquor from the first reactor to a second reactor; and contacting the partially oxidized white liquor with oxygen in the second reactor to fully oxidize the white liquor, thereby fully oxidizing sulfur in the partially oxidized white liquor;

wherein nanobubbles containing the oxygen required for the oxidation are fed into the unoxidized white liquor via a first introduction device located in a feed line for supplying the unoxidized white liquor to the first reactor and via a second introduction device located in the first reactor.

2. The process as claimed in claim 1, wherein the oxygen-containing nanobubbles are supplied at least partly by generating nanobubbles in a feed for the white liquor or for a fluid to be fed into the white liquor that has flow connection to the first reactor.

3. The process as claimed in claim 2, wherein the fluid is fresh water.

4. The process as claimed in claim 1, wherein the oxygen required for the oxidation is fed to at least one of the first reactor and the second reactor at least partly in the form of oxygen-containing nanobubbles.

5. The process as claimed in claim 1, further comprising using the white liquor that has been treated with the oxygen as an alkali source in bleaching stages of a chemical pulp bleaching operation.

6. The process as claimed in claim 5, wherein using the white liquor that has been treated with the oxygen as an alkali source in bleaching stages of a chemical pulp bleaching operation comprises:

an oxygen delignification process comprising feeding the partially oxidized white liquor from the first reactor into a chemical pulp suspension; and a peroxide bleaching process comprising feeding the fully oxidized white liquor from the second reactor into the oxygen-delignified chemical pulp suspension, thereby forming a bleached chemical pulp suspension.

7. The process as claimed in claim 1, wherein the nanobubbles containing the oxygen required for the oxidation are fed into the partially oxidized white liquor via a third introduction device located in at least one of the second reactor and a feed line for conveying the partially oxidized white liquor from the first reactor to the second reactor.

8. The process as claimed in claim 1, wherein the nanobubbles containing the oxygen required for fully oxidizing sulfur in the partially oxidized white liquor in the second reactor are introduced via at least one of the first introduction device and the second introduction device; and wherein the nanobubbles containing the oxygen required for fully oxidizing sulfur in the partially oxidized white liquor are conveyed from the first reactor into the second reactor with the partially oxidized white liquor via a feed line for conveying the partially oxidized white liquor from the first reactor to the second reactor.

9. The process as claimed in claim 8, wherein contacting the partially oxidized white liquor with oxygen in the second reactor comprises introducing additional nanobubbles containing the oxygen required for fully oxidizing sulfur in the partially oxidized white liquor via a third introduction device located in at least one of the second reactor and the feed line for conveying the partially oxidized white liquor from the first reactor to the second reactor.

10. An apparatus for oxidizing white liquor, the apparatus comprising:

a first reactor in which unoxidized white liquor is contacted with oxygen to partially oxidize the white liquor, thereby partially oxidizing sulfur compounds in the white liquor;

a second reactor in which the partially oxidized white liquor is contacted with oxygen to fully oxidize the white liquor, thereby fully oxidizing sulfur in the partially oxidized white liquor;

a feed line for conveying the partially oxidized white liquor from the first reactor into the second reactor; and a plurality of introduction devices for introducing oxygen in the form of nanobubbles, the plurality of introduction devices comprising a first introduction device located in a feed line for supplying the unoxidized white liquor to the first reactor and comprising a second introduction device located in the first reactor.

11. The apparatus as claimed in claim 10, wherein the plurality of introduction devices comprises a third introduction device located in at least one of the second reactor and the feed line for conveying the partially oxidized white liquor from the first reactor to the second reactor.

12. The apparatus as claimed in claim 10, wherein the plurality of introduction devices comprises a third introduction device located in the second reactor and a fourth introduction device in the feed line for conveying the partially oxidized white liquor from the first reactor to the second reactor.

13. The apparatus as claimed in claim 10, further comprising a feed line for feeding the partially oxidized white liquor from the first reactor into a chemical pulp suspension, thereby utilizing the partially oxidized white liquor as an alkali source for an oxygen delignification step of a chemical pulp bleaching operation.

14. The apparatus as claimed in claim 13, further comprising a feed line for feeding the fully oxidized white liquor from the second reactor into the oxygen-delignified chemical pulp suspension, thereby utilizing the fully oxidized white liquor as an alkali source for a peroxide bleaching step of the chemical pulp bleaching operation.

* * * * *